US009841031B2

(12) United States Patent
Clarke

(10) Patent No.: US 9,841,031 B2
(45) Date of Patent: Dec. 12, 2017

(54) GAS TURBINE ENGINE

(71) Applicant: ROLLS-ROYCE PLC, London (GB)

(72) Inventor: Paul Dennis Clarke, Derby (GB)

(73) Assignee: ROLLS-ROYCE plc, London (GB)

( * ) Notice: Subject to any disclaimer, the term of this patent is extended or adjusted under 35 U.S.C. 154(b) by 231 days.

(21) Appl. No.: 14/830,367

(22) Filed: Aug. 19, 2015

(65) Prior Publication Data

US 2016/0084260 A1 Mar. 24, 2016

(30) Foreign Application Priority Data

Sep. 18, 2014 (GB) ..... 1416505.4

(51) Int. Cl.
*F04D 29/32* (2006.01)
*F01D 5/30* (2006.01)

(52) U.S. Cl.
CPC ..... *F04D 29/323* (2013.01); *F01D 5/303* (2013.01); *F01D 5/3007* (2013.01); *F01D 5/3038* (2013.01); *F04D 29/324* (2013.01); *F05D 2250/70* (2013.01)

(58) Field of Classification Search
CPC ..... F01D 5/3007; F01D 5/303; F01D 5/3038; F04D 29/323; F04D 29/324; F05D 2250/70
See application file for complete search history.

(56) References Cited

U.S. PATENT DOCUMENTS 3,045,968 A * 7/1962 Willis ..... F01D 5/3007 416/216
4,191,509 A * 3/1980 Leonardi ..... F01D 5/3007 416/219 R
4,260,331 A * 4/1981 Goodwin ..... F01D 5/3007 416/219 R
4,692,976 A * 9/1987 Andrews ..... F01D 5/3007 29/557
4,824,328 A * 4/1989 Pisz ..... F01D 5/3007 416/219 R
5,147,180 A * 9/1992 Johnson ..... F01D 5/3007 416/219 R
5,160,242 A * 11/1992 Brown ..... F01D 5/20 416/193 A
5,554,005 A * 9/1996 Nguyen ..... F01D 5/3007 416/219 R (Continued)

FOREIGN PATENT DOCUMENTS

EP 0431766 A1 6/1991
EP 1048821 A2 11/2000

(Continued)

OTHER PUBLICATIONS

Feb. 26, 2015 Search Report issued in British Patent Application No. GB1416505.4.

(Continued)

*Primary Examiner* — Igor Kershteyn
(74) *Attorney, Agent, or Firm* — Oliff PLC

(57) ABSTRACT

A compressor disc for a compressor of a gas turbine engine includes a circumferentially extending groove for receiving blade roots of a plurality of compressor blades. The circumferentially extending groove includes a planar surface offset into the groove.

15 Claims, 6 Drawing Sheets

(56) References Cited

U.S. PATENT DOCUMENTS

| | | | | |
|---|---|---|---|---|
| 5,584,658 | A * | 12/1996 | Stenneler | F01D 5/3038 416/215 |
| 6,106,188 | A | 8/2000 | Krautzig et al. | |
| 7,594,799 | B2 * | 9/2009 | Miller | F01D 5/147 416/219 R |
| 2005/0008491 | A1 | 1/2005 | Follonier et al. | |
| 2005/0175462 | A1 | 8/2005 | Lagrange et al. | |
| 2014/0140852 | A1 | 5/2014 | Bluck | |

FOREIGN PATENT DOCUMENTS

| | | | |
|---|---|---|---|
| EP | 1564378 | A2 | 8/2005 |
| EP | 1584792 | A1 | 10/2005 |
| EP | 2 441 921 | A1 | 4/2012 |
| GB | 2171150 | A | 8/1986 |
| JP | H10-141002 | A | 5/1998 |

OTHER PUBLICATIONS

Feb. 16, 2016 Search Report issued in European Patent Application No. 15181564.

* cited by examiner

GAS TURBINE ENGINE

FIELD OF INVENTION

The present invention relates to a compressor disc and/or a compressor for a gas turbine engine, and/or a gas turbine engine.

BACKGROUND

Gas turbine engines are typically employed to power aircraft. Typically a gas turbine engine will comprise an axial fan driven by an engine core. The engine core is generally made up of one or more turbines which drive respective compressors via coaxial shafts. The fan is usually driven directly off an additional lower pressure turbine in the engine core.

The air is generally compressed firstly in an intermediate pressure compressor and then in a high pressure compressor. Each stage of the compressor typically utilises multiple discs each with a set of rotor blades of aerofoil cross section. The discs are often bolted or welded together to form a compressor drum. The rotor blades and discs may be in the form of a blisk, or alternatively the blades may be connected to the disc via grooves provided in the disc.

The blades can be mounted either axially, where a series of slots are provided in the disc to receive a dovetail or fir tree blade root, or the blades can be mounted circumferentially.

Circumferential mounting will now be described in more detail with reference to FIG. 1. A disc 153 is provided having a groove 154 that extends circumferentially around the periphery of the disc. The roots 50 of the compressor blades 40 are received in the circumferential groove via a loading slot. Each compressor blade is adjacent a neighbouring compressor blade with a platform 47 of the blade acting to space the aerofoil portion of the blades apart. A locking device, e.g. a locknut 39 and jack screw, is then used to secure the blades 40 in the groove 154.

It is necessary to machine the groove 154 with high precision to restrict the stress experienced by the compressor blade and groove during operation of the compressor.

SUMMARY OF INVENTION

In the aerospace industry it is often desirable to reduce the stress components are subjected to as this can improve component reliability, reduce manufacturing tolerances and/or ease manufacturing and improve component life. The invention seeks to provide a rotor with blades (e.g. a compressor) where the peak stress applied to the blade roots and the groove of the disc during operation is reduced. The invention also seeks to provide a rotor with mounted blades that is easier to manufacture than comparable rotors of the prior art.

Generally the invention seeks to provide a rotor and blade arrangement for a gas turbine engine, e.g. a compressor, where the geometry of the disc groove and/or blade root is modified so that the likelihood of the pressure flanks or planar surfaces of the groove and blade root contacting during operation of the gas turbine engine is increased compared to rotor arrangements of the prior art.

In a first aspect there is provided a disc and blade arrangement (e.g. a compressor) for a gas turbine engine. The rotor and blade arrangement comprises a disc having a groove provided on the periphery of the disc and a blade mounted to the disc, the blade having a root that is received in the groove of the disc and retained therein. The blade root includes a planar surface and the disc groove includes a planar surface. A curved surface is positioned adjacent the planar surface of the groove and a curved surface is positioned adjacent the planar surface of the blade root.

The planar surfaces of the blade root and the groove may be arranged such that under the condition of the blades experiencing a radially outward force during operation, the planar surfaces of the blade roots contact the corresponding planar surfaces of the disc grooves and a gap is provided between the curved surface of the groove and the curved surface of the blade root.

The blade may be moveable between a first position and a second position, in the first position (e.g. a position of the blade under centrifugal force during use of a gas turbine engine) the planar surface of the disc may contact the planar surface of the groove and a gap is provided between the curved surface of the groove (e.g. the entire curved surface of the groove), and in the second position (e.g. a position of the blade at rest, e.g. when the disc is not turning) a gap may be provided between the planar surface of the groove and the planar surface of the blade root.

The planar surface of the groove may be considered to be a disc pressure flank and the planar surface of the blade root may be considered to be a blade pressure flank. The curved surface of the groove may be considered to be a bulb of the groove having a bulb radius and the curved surface of the blade root may be considered to be a bulb of the groove having a bulb radius.

The groove may be a circumferential groove. A plurality of blades may be mounted to the disc via the circumferential groove.

The planar surface of the groove may be provided at a position offset radially inward from the curved surface of the groove. For example, a radially inward step or ramp may be provided between the curved surface and the planar surface.

The groove may be considered as including a radially inward protrusion defining the planar surface.

In a second aspect there is provided a compressor disc for a compressor of a gas turbine engine. The compressor disc comprises a circumferentially extending groove for receiving blade roots of a plurality of compressor blades. The circumferentially extending groove comprises a planar surface (or pressure flank) offset into the groove. The planar surface may be considered to be offset radially into the groove (e.g. with respect to the local radial direction of the groove).

The disc groove may comprise a curved surface adjacent the planar surface and the groove may comprise a step or a ramp between the curved surface and the planar surface to offset the planar surface into the groove.

The following described features are optional features of the first and/or the second aspect.

The planar surface may be offset into the groove by a distance equal to or between 0.03 mm and 0.1 mm.

The groove may define a base and a radially extending wall. Each blade root may define a base and a radially extending wall. The radially extending wall of the disc groove may include the planar surface and the curved surface and the radially extending wall of the blade root may include a planar surface in opposition to the planar surface of the disc groove and a curved surface in opposition to the curved surface of the disc groove. The opposing planar surfaces of the disc groove and the blade root may be positioned closer together than the opposing curved surfaces of the disc groove and blade root.

The groove may define a transition region adjoining the base and the curved surface. The transition region of the groove may include a curved surface and/or a planar surface. The blade root may define a transition region adjoining the base and the curved surface. The transition region of the blade root may include a curved surface and/or a planar surface.

The planar surface of the blade root may extend along the blade root in the circumferential direction. The planar surface of the disc groove may extend along the disc groove in the circumferential direction The planar surface of the blade root may be angled to the spanwise and axial direction of the blade, e.g. angled by 40° to 50° e.g. 45° to the spanwise direction and 40° to 50° e.g. 45° to the axial direction. The planar surface of the disc groove may be angled to the spanwise and axial direction, e.g. angled by 40° to 50° e.g. 45° to the spanwise direction and 40° to 50° e.g. 45° to the axial direction.

As is understood in the art, compressor blades have a tip, a leading edge, a trailing edge, a pressure side and a suction side. In the present application, the spanwise direction is defined as the direction extending between the blade root and the blade tip. However, the spanwise direction may also be considered as a radial direction with respect to the disc. The circumferential direction is the direction extending circumferentially around the disc. The axial direction is defined with respect to the axial flow of air through the gas turbine engine.

The blade root may include two planar surfaces one on each axial side of the blade. The disc groove may include two planar surfaces. One planar surface of the groove may oppose one planar surface of the blade root and the other of the planar surfaces of the groove may oppose the other of the planar surfaces of the root.

A locking arrangement may be provided to retain the blades in the circumferential groove.

The blade may comprise a seal wing adjacent the blade root.

The disc groove may comprise a necked portion. For example, the neck may be provided adjacent the planar surface. In exemplary embodiments, the surface of the disc groove may extend from a base to a curved portion, the curved portion may extend to a planar portion and the planar portion may extend to a neck portion. A transition region may be provided between the base and the curved portion. The disc groove may be symmetrical about an axis in the spanwise direction.

In a third aspect there is provided a compressor disc for a compressor of a gas turbine engine. The compressor disc comprises a circumferentially extending groove for receiving blade roots of a plurality of compressor blades. The circumferentially extending groove has a substantially dovetail shaped cross section. The circumferentially extending groove includes a pressure flank that is offset radially inward from a nominal profile of the groove. For example, the groove may be considered to be substantially dovetail in cross section and the groove may be considered to have a radially inward projection that has a planar surface (e.g. a pressure flank) for contacting the pressure flank of a blade.

The compressor disc of the third aspect may have one or more of the optional features of the compressor disc of the second aspect.

In a fourth aspect there is provided a compressor comprising the compressor disc according to the second aspect or third, and a plurality of blades having a blade root, the roots of the plurality of the blades being received in the groove of the compressor disc.

The compressor may be an axial compressor.

In a fifth aspect there is provided a gas turbine engine comprising the arrangement according to the first aspect and/or the compressor according to the fourth aspect.

DESCRIPTION OF DRAWINGS

The invention will now be described, by way of example only, with reference to the accompanying drawings in which.

DETAILED DESCRIPTION

Figure 2:
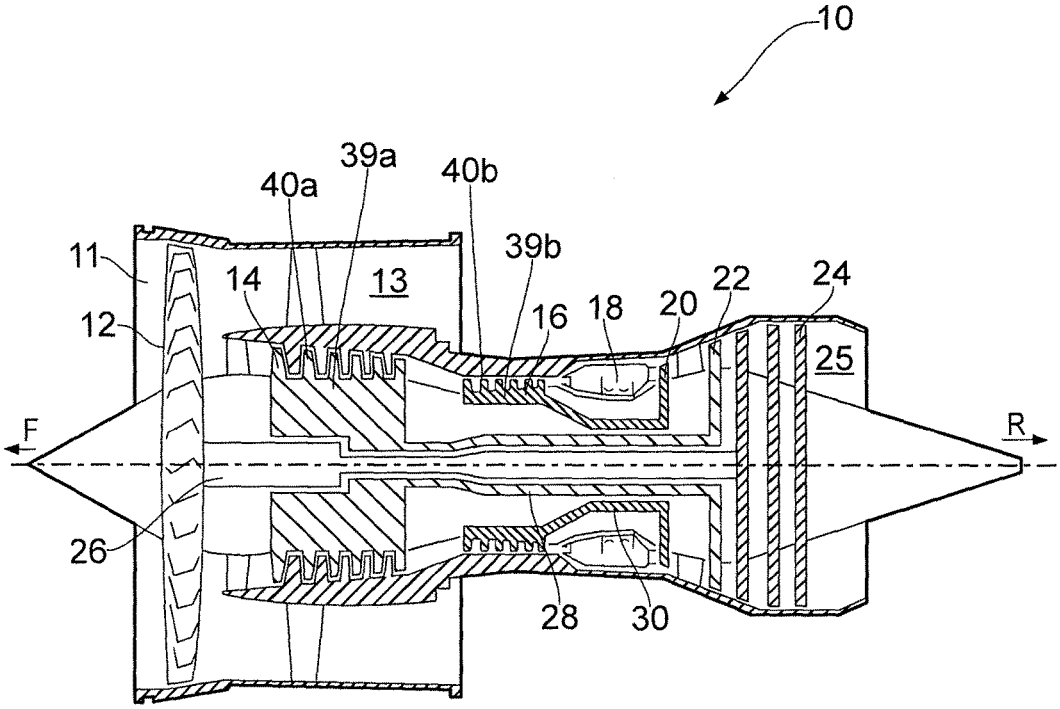
FIG. 2 illustrates a gas turbine engine.

With reference to FIG. 2 a bypass gas turbine engine is indicated at 10. The engine 10 comprises, in axial flow series, an air intake duct 11, fan 12, a bypass duct 13, an intermediate pressure compressor 14, a high pressure compressor 16, a combustor 18, a high pressure turbine 20, an intermediate pressure turbine 22, a low pressure turbine 24 and an exhaust nozzle 25. The fan 12, compressors 14, 16 and turbines 20, 22, 24 all rotate about the major axis of the gas turbine engine 10 and so define the axial direction of the gas turbine engine.

Air is drawn through the air intake duct 11 by the fan 12 where it is accelerated. A significant portion of the airflow is discharged through the bypass duct 13 generating a corresponding portion of the engine thrust. The remainder is drawn through the intermediate pressure compressor 14 into what is termed the core of the engine 10 where the air is compressed. A further stage of compression takes place in the high pressure compressor 16 before the air is mixed with fuel and burned in the combustor 18. The resulting hot working fluid is discharged through the high pressure turbine 20, the intermediate pressure turbine 22 and the low pressure turbine 24 in series where work is extracted from the working fluid. The work extracted drives the intake fan 12, the intermediate pressure compressor 14 and the high pressure compressor 16 via shafts 26, 28, 30. The working fluid, which has reduced in pressure and temperature, is then expelled through the exhaust nozzle 25 generating the remainder of the engine thrust.

In the present application, a forward direction F extends in an axial direction towards the air intake duct 11 and a rearward direction R extends in an axial direction towards the exhaust nozzle 25.

The intermediate pressure (IP) compressor 14 and the high pressure (HP) compressor 16 each comprise a plurality of discs forming a compressor drum 39*a*, 39*b* and an array of radially extending compressor blades 40*a*, 40*b* mounted to the discs. The general form of the compressor blades of the intermediate pressure (IP) compressor and the high pressure compressor (HP) compressor are similar, but the IP compressor blades are larger than the HP compressor blades.

Figure 3A:
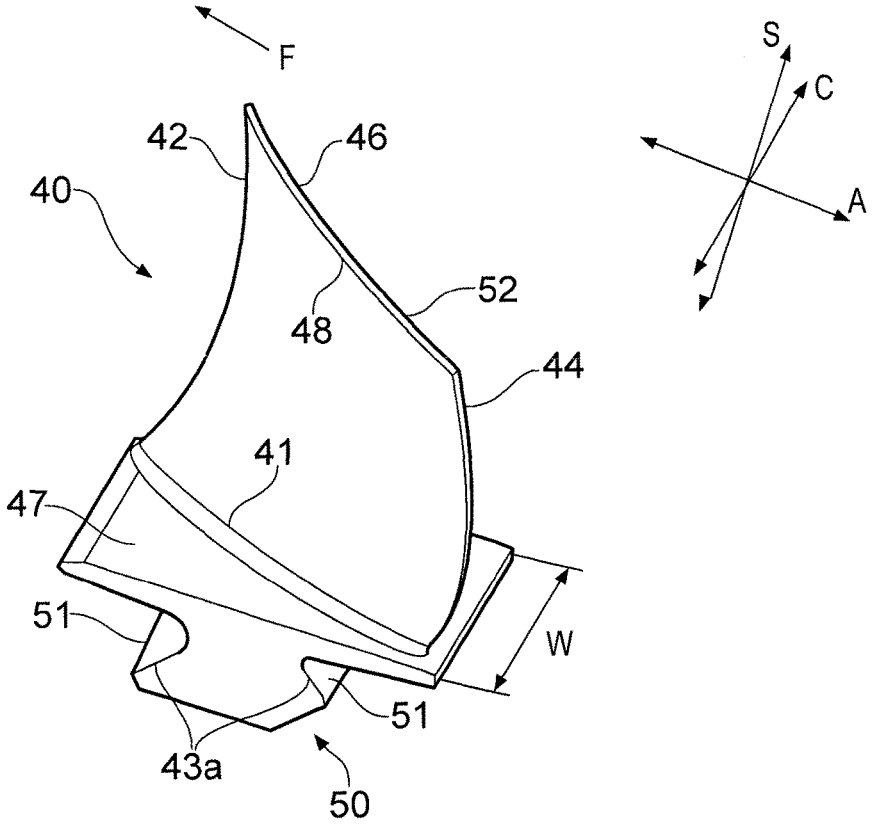
FIGS. 3A and 3B illustrate perspective views of a compressor blade.
Figure 3B:
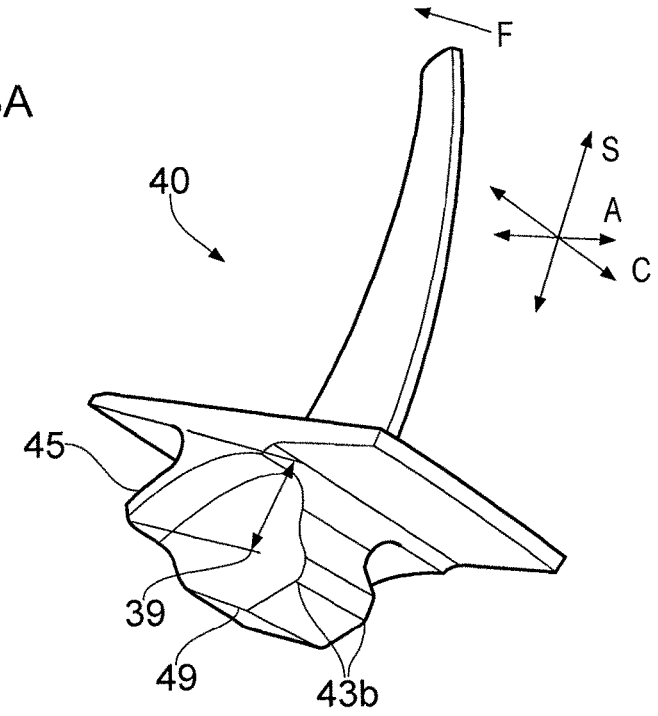

Referring to FIGS. 3A and 3B, an exemplary compressor blade 40 is illustrated. The compressor blade 40 comprises an aerofoil portion having a leading edge 42, a trailing edge 44, a concave pressure surface 46 extending from the leading edge to the trailing edge and a convex suction surface 48 extending from the leading edge to the trailing edge. The compressor blade has a root 50 via which the blade can be connected to the disc. The compressor blade has a tip 52 at an opposing end to the root. The compressor blade also has an integral platform 47 adjacent the root in a spanwise direction. The platform extends axially and circumferentially, the circumferential width W is often referred to as the wedge width. An aerofoil/platform fillet 41 is provided at the transition between the aerofoil portion and the platform 47. A seal wing 45 is provided at the circumferential ends of the blade root 50. The seal wing is provided to limit block leakage flow of higher pressure air flowing to an upstream lower pressure region. The spanwise distance from the underside of the platform to a forward position on the seal wing is referred to as the platform cut back 39. Many of the corners of the blade root have a blend radius 43*a* or are chamfered 43*b*.

The blade root 50 includes a planar surface 51 on each axial side of the blade root, the planar surface being angled to the axial and the spanwise direction. The planar surface may be angled at approximately 45° to the axial direction and approximately 45° to the spanwise direction. The planar surface may be referred to as the pressure flank of the blade root. The blade root includes a base (or root end face) 49, which in this embodiment is substantially planar and extends in the axial direction. A curved surface is positioned adjacent the planar surface and is often referred to as a bulb having a bulb radius. A planar surface angled to the spanwise and axial direction connects the base 49 and the curved surface. As will be appreciated by those skilled in the art, the blade root may have varying configuration, for example the base of the blade root may be curved and the region between the base and the curved portion may be curved.

In the present application, an axial direction A is defined by an axis extending from the front of the engine to the rear of the engine and defined by the flow of air through the gas turbine engine; a spanwise direction S is a direction extending between the tip of the blade and the root 50 of the blade 40; and the circumferential direction C is a direction extending circumferentially around the disc of the compressor 14, 16.

Figure 1:
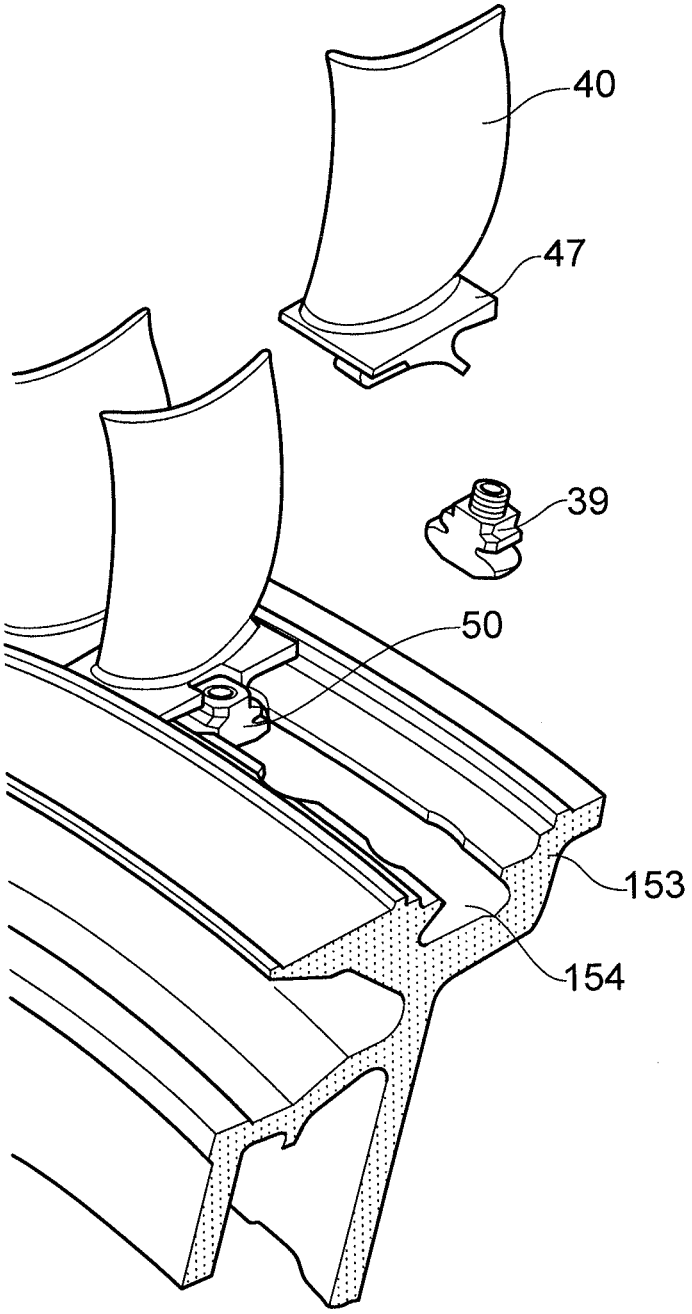
FIG. 1 PRIOR ART
FIG. 1 illustrates a partial perspective view of a disc including a groove of the prior art.

Similarly to the compressor described with reference to FIG. 1, each disc includes a groove extending circumferentially around the periphery of the disc. The roots 50 of a plurality of the blades 40 are received in the circumferential groove of the disc to radially mount the blades 40 to the disc. A locking arrangement is provided to lock the blades 40 in position with respect to the disc.

Figure 4:
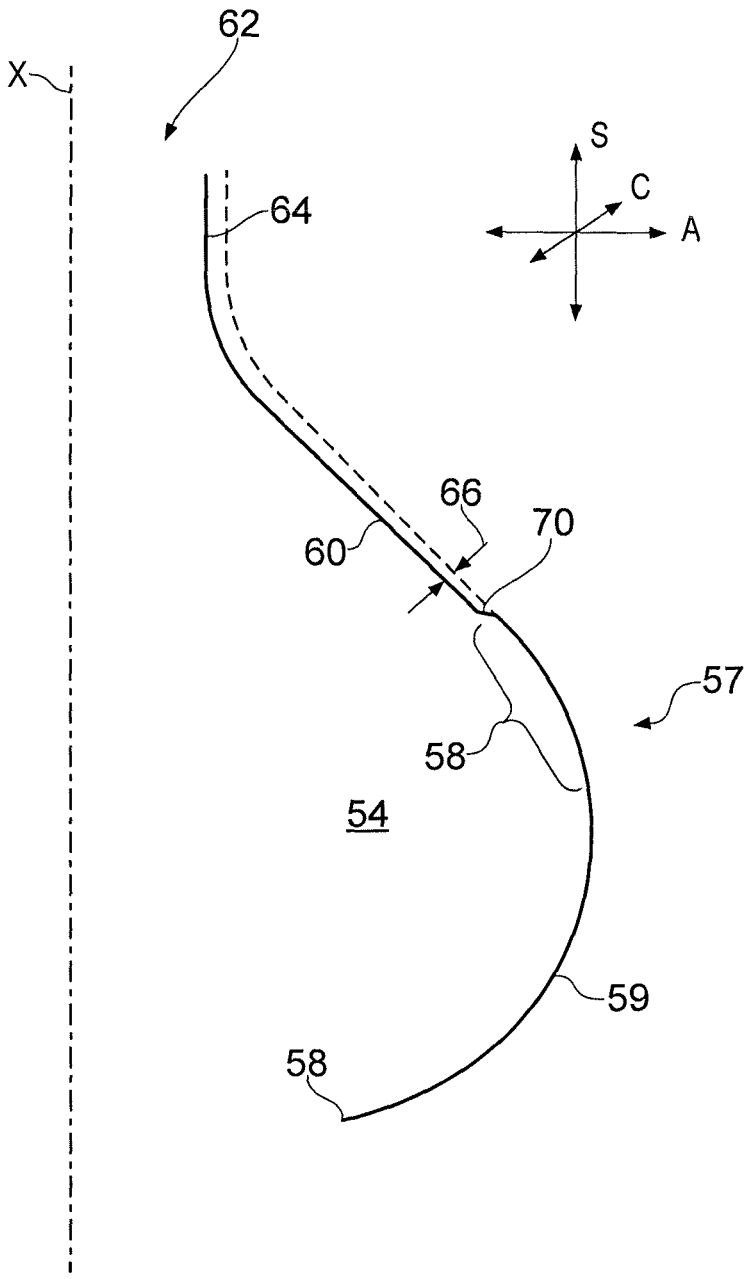
FIG. 4 illustrates a partial cross section of a groove provided in a disc of a compressor of the gas turbine engine of FIG. 3.
Figure 5:
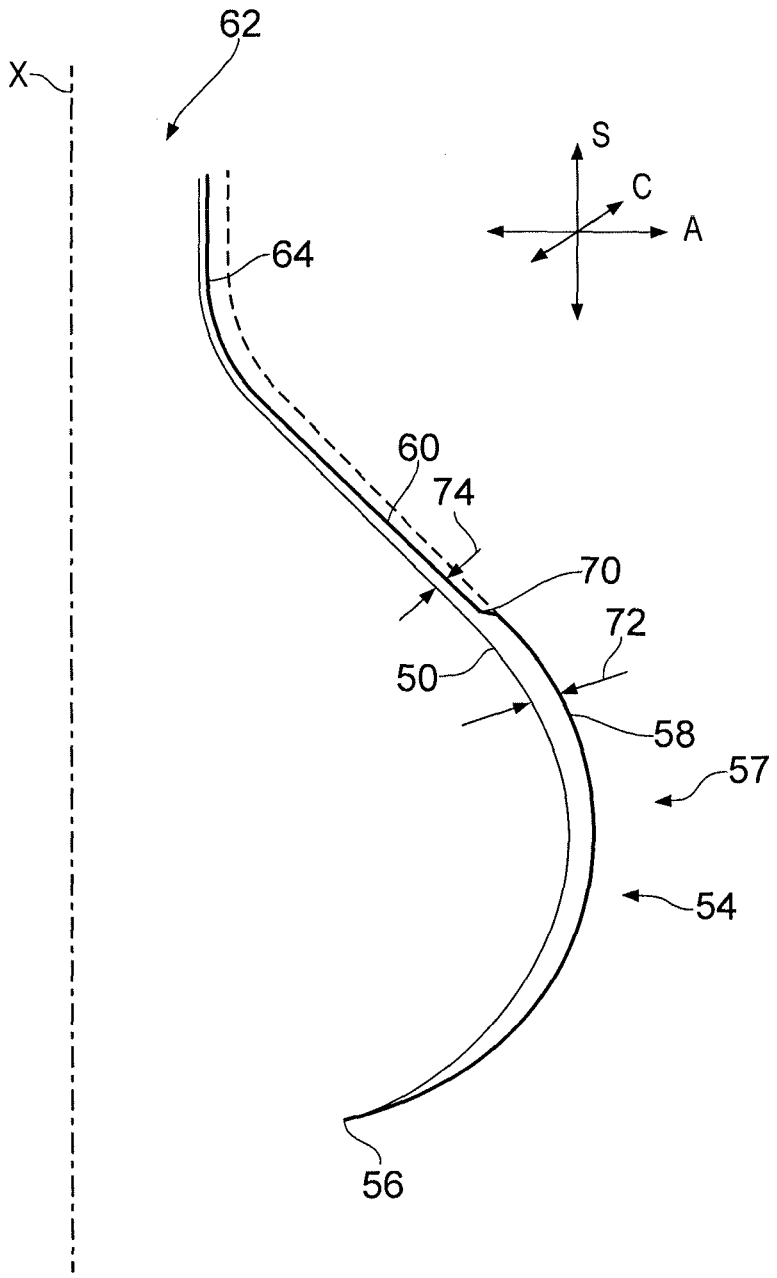
FIG. 5 illustrates a partial cross section of the groove of FIG. 4 with the outline of a root of a compressor blade in an at rest position.

Referring now to FIGS. 4 and 5, the circumferential groove on the disc will be explained in more detail. FIGS. 4 and 5 show a partial cross section through the groove 54 in the disc. The groove 54 has a cross section having a substantially modified dovetail shape. The inner surface of the groove is defined by a base 56 and radially extending walls 57 either side of the base 56. The radially extending walls can be considered as extending generally in the spanwise direction with respect to the connected compressor blade. The radially extending walls include a planar surface 60, which is often referred to as the pressure flank of the groove. The planar surface is angled to the spanwise direction by approximately 45° and is angled to the axial direction by approximately 45°. A curved portion 58, often referred to as a bulb and having a curvature often referred to as the bulb radius, is positioned adjacent the planar portion 60. The region 59 between the curved portion 58 and the base is also curved. In the present embodiment the base 56 and the region 59 are curved but in alternative embodiments the base 56 and region 59 may have alternative geometry depending on loading requirements. A neck region 64 is provided between the planar surface 60 and a groove opening 62. Only a portion of the groove is shown in FIG. 4, but the groove shape is substantially the same on both axial sides (i.e. the groove shape is mirrored about the axis X in FIGS. 4 and 5).

Referring in particular to FIG. 4, the planar surface 60 is inwardly offset by a distance 66 from the curved portion 58. The distance 66 may be between 0.03 mm and 0.1 mm, and in the present embodiment is 0.05 mm. An outline 168 of a groove of the prior art is shown in FIG. 4 for the purpose of comparing the groove of the present embodiment to a groove of the prior art.

The groove may be considered as being provided with a step 70 in an inward direction (with respect to the groove) at the transition from the curved surface 58 to the planar surface 60. Alternatively, the planar surface 60 could be considered as being defined by a protrusion provided in the groove 54.

Referring now to FIG. 5, an outline of a root 50 of a blade 40, when the compressor is at rest and the blade is arranged vertically in the groove is shown. As can be seen, a gap 72 is provided between the blade root 50 and the groove 54 in the region of the curved surface 58 and a gap 74 is provided between the blade roots and the groove in the region of the planar surface 60. The provision of the planar surface 60 offset radially into the groove means that the gap 72 provided between the blade root and the groove in the region of the curved portion 58 (or the region of the bulb radius) is greater than the gap 74 provided between the blade root and the groove in the region of the planar surfaces (or pressure flanks) 51, 60.

Figure 6:
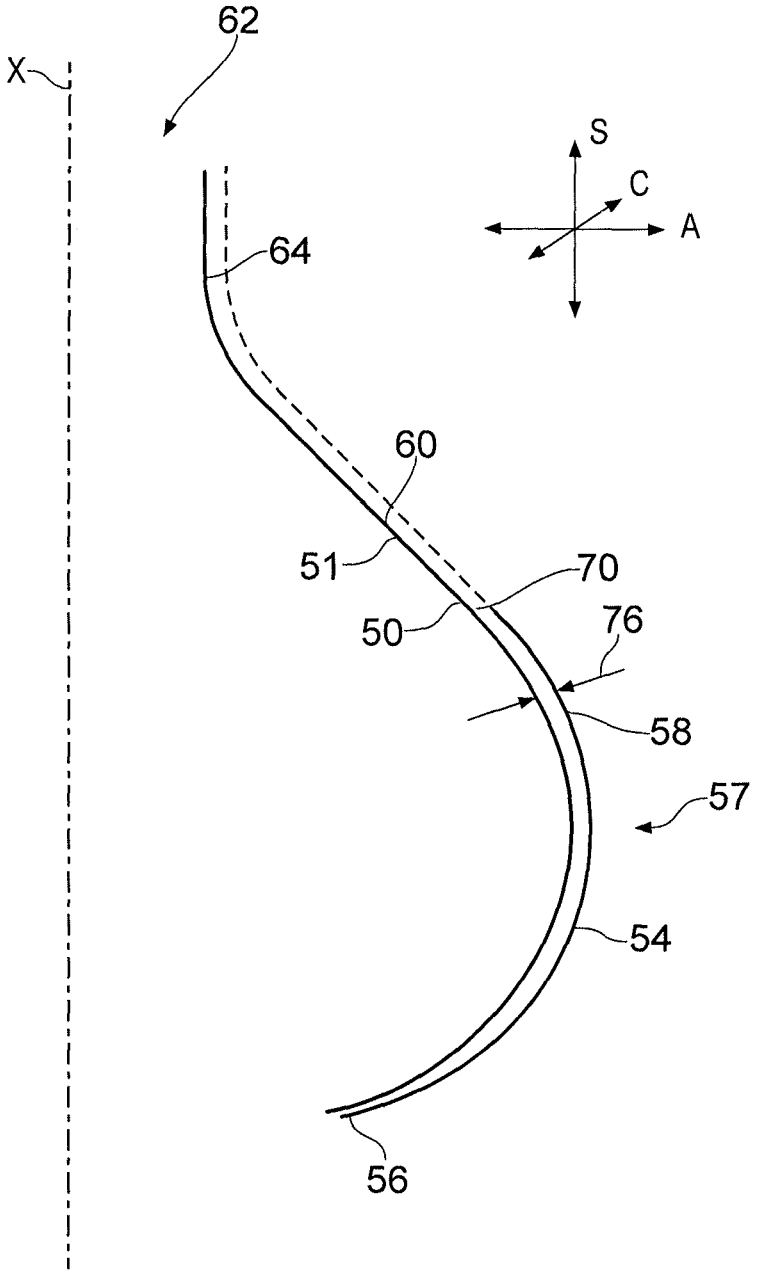
FIG. 6 illustrates a partial cross section of the groove of FIG. 4 with the outline of a root of a compressor blade during operation of the compressor.

Referring now to FIG. 6, an outline of a root 50 of a blade 40, during operation of the compressor is shown. As can be seen, the planar surface 60 or the pressure flank of the groove 54 is in contact with the planar surface 51 or pressure flank of the blade root 50. A clearance gap 76 is provided between the curved portion of the blade root and the curved portion (or bulb) of the disc groove.

Now referring back to FIG. 1, the operation of a compressor of the prior art will be explained for comparison with the operation of the presently described compressor. Disc grooves of the prior art need to be machined with high precision to ensure that the planar surfaces (or pressure flanks) contact during operation of the compressor. The tolerance required is often difficult to achieve. As such, often during use of the compressor of the prior art, the blade will experience a radially outward force, and move towards the planar surface or pressure flank of the groove. However, instead of the pressure flank of the blade root contacting the pressure flank of the disc groove the blade root will contact the curved region (i.e. the bulb radius) directly adjacent the pressure flank. The contact of the curved region results in a point contact which can result in higher than desirable stresses in the disc groove and the blade root.

The design of the presently described disc groove mitigates the risk of the curved portions of the blade root and groove contacting during operation of the compressor so as to avoid undesirably high stresses in the blade root and groove. During use of the presently described compressor 12, the compressor blades 40 will experience radially outward forces, and the planar surfaces or pressure flanks will contact instead of the curved surfaces due to the provision of planar surfaces that are positioned radially into the groove from the position of the curved portion. This means that the force is distributed over a much larger area so the stresses in the blade root and the disc groove are reduced.

The use of the described circumferential groove can reduce the number of components scrapped or reworked because the tolerance range of the curved portion (or bulb radius) may not need to be as tight as that required for compressors of the prior art. The life of the compressor disc and blades may also be extended.

It will be appreciated by one skilled in the art that, where technical features have been described in association with one or more embodiments, this does not preclude the combination or replacement with features from other embodiments where this is appropriate. Furthermore, equivalent modifications and variations will be apparent to those skilled in the art from this disclosure. Accordingly, the exemplary embodiments, of the invention set forth above are considered to be illustrative and not limiting.

In the presently described embodiment the root of compressor blade is similar to a comparable compressor blade root of the prior art. However, in alternative embodiments the compressor blade root may be modified for use with the described disc groove. For example, the compressor blade may include a planar surface that is offset from the main body of the root towards the groove, e.g. a planar surface defined by a protrusion on the blade root.

In the described embodiment the disc is of the type having a circumferential groove, but the general profile of the groove may also be applicable to axial grooves.

The base of the groove in the presently described embodiment is substantially curved, but the profile of the groove and the profile of the base of the blade root may vary depending on loading requirements.

In the described embodiment the blade root has a dove tail shaped cross section, but in alternative embodiments the blade root may have a fir tree shaped cross section. In such embodiments a plurality of pressure flanks may be provided on the blade root and on the groove, and each of the plurality of pressure flanks of the groove may be radially offset into the groove.

The invention claimed is:

1. A disc and blade arrangement for a gas turbine engine, the disc and blade arrangement comprising:

a disc having a groove provided on the periphery of the disc; and a blade mounted to the disc, the blade having a root that is received in the groove of the disc and retained therein, wherein the blade root includes a planar surface and a curved surface is positioned adjacent the planar surface of the blade root, and the disc groove includes a planar surface and a curved surface is positioned adjacent the planar surface of the groove, and wherein the blade is moveable between a first position and a second position, in the first position the planar surface of the disc contacts the planar surface of the groove and a gap is provided between the curved surface of the groove, and in the second position a gap is provided between the planar surface of the groove and the planar surface of the blade root.

2. The arrangement according to claim 1, wherein the groove is a circumferential groove and a plurality of blades are mounted to the disc via the circumferential groove.

3. The arrangement according to claim 1, wherein the planar surface of the groove is provided at a position offset radially inward from the curved surface of the groove.

4. The arrangement according to claim 1, wherein the groove defines a base and a radially extending wall and each blade root defines a base and a radially extending wall, and wherein the radially extending wall of the disc groove includes the planar surface and the curved surface and the radially extending wall of the blade root includes a planar surface in opposition to the planar surface of the disc groove and a curved surface in opposition to the curved surface of the disc groove, and wherein the opposing planar surfaces of the disc groove and the blade root are positioned closer together than the opposing curved surfaces of the disc groove and blade root.

5. The arrangement according to claim 1, wherein the planar surface of the blade root is angled to the spanwise and axial direction of the blade and the planar surface of the disc groove is angled to the spanwise and axial direction.

6. The arrangement according to claim 1, wherein the blade root includes two planar surfaces one on each axial side of the blade, and wherein the groove includes two planar surfaces, one planar surface of the groove opposing one of the planar surfaces of the blade root and the other of the planar surfaces of the groove opposing the other of the planar surfaces of the root.

7. The arrangement according to claim 1, wherein the disc groove comprises a necked portion.

8. The arrangement according to claim 1, wherein the groove is dove tail shaped and the root is dove tail shaped, and the planar surface is defined by a radially inward protrusion from a planar surface of the dovetail shaped groove.

9. The arrangement according to claim 8, wherein the radially inward protrusion is adjacent a necked portion of the dovetail shaped groove.

10. The arrangement according to claim 8, wherein the groove includes a further planar surface defined by a further radially inward protrusion positioned adjacent a necked portion of the dovetail shaped groove on an opposite side of the necked portion to the other protrusion.

11. A gas turbine engine comprising the arrangement according to claim 1.

12. A compressor disc for a compressor of a gas turbine engine, the compressor disc comprising:

a circumferentially extending groove for receiving blade roots of a plurality of compressor blades, wherein the groove comprises a planar surface offset radially into the groove.

13. The compressor disc according to claim 12, wherein the disc groove comprises a curved surface adjacent the planar surface and the groove comprises a step or a ramp between the curved surface and the planar surface to offset the planar surface radially into the groove.

14. The compressor disc according to claim 12, wherein the planar surface is offset into the groove by a distance equal to or between 0.03 mm and 0.1 mm.

15. A compressor comprising the compressor disc according to claim 12, and a plurality of blades having a blade root, the roots of the plurality of the blades being received in the groove of the compressor disc.

* * * * *